US005390004A

United States Patent [19]

Hopkins

[11] Patent Number: 5,390,004

[45] Date of Patent: Feb. 14, 1995

[54] THREE-INPUT, THREE-OUTPUT FUZZY LOGIC PRINT QUALITY CONTROLLER FOR AN ELECTROPHOTOGRAPHIC PRINTER

[75] Inventor: Mark A. Hopkins, Rochester, N.Y.

[73] Assignee: Xerox Corporation, Stamford, Conn.

[21] Appl. No.: 239,792

[22] Filed: May 9, 1994

[51] Int. Cl.[6] ..... G03G 21/00

[52] U.S. Cl. ..... 355/208; 355/214; 355/246; 395/900

[58] Field of Search ..... 355/200, 202–204, 355/207, 208, 214, 246; 395/900, 21; 371/16.4; 364/274.5, 274.6, 274.9, 920.7, 972.4

[56] References Cited

U.S. PATENT DOCUMENTS

| | | | |
|---|---|---|---|
| 5,204,538 | 4/1993 | Genovese | 250/571 |
| 5,204,935 | 4/1993 | Mihara et al. | 395/3 |
| 5,214,476 | 5/1993 | Nomura et al. | 355/246 |
| 5,321,468 | 6/1994 | Nakane et al. | 355/208 |

OTHER PUBLICATIONS

"Panasonic FP-1780 Copier Sales Brochure".

Fuzzy Logic in Control Systems: Fuzzy Logic Controller-Part I—Chuen Chien Lee 1990 IEEE Publ. No. 0018-9472/90/0300-0404$.

Fuzzy Logic in Control Systesm: Fuzzy Logic Controller—Part II—Chuen Chien Lee 1990—IEEE Pub. No. 0018-9472/90/0300-0404.

*Primary Examiner*—Matthew S. Smith

*Attorney, Agent, or Firm*—R. Hutter

[57] ABSTRACT

A control method for optimizing print quality in an electrophotographic printer uses a fuzzy-logic technique with solid-area, halftone, and light toner density as control inputs, and scorotron voltage, ROS laser power, and cleaning voltage as outputs. The fuzzy-logic program involves two two-input error subset matrices, one for simultaneous readings of solid-area and halftone densities, and one for successive light toner density readings.

10 Claims, 6 Drawing Sheets

PRESENT

| | | LARGE NEG | MED NEG (0.3) | SMALL NEG (0.7) | ZERO | SMALL POS | MED POS | LARGE POS |
|---|---|---|---|---|---|---|---|---|
| | LARGE NEG | 5 | 3 | 1 | 0 | 0 | -3 | -4 |
| (0.5) | MED NEG | 4 | 3 | 1 | 0 | 0 | -2 | -3 |
| (0.5) | SMALL NEG | 2 | 1 | 1 | 0 | 0 | 0 | 0 |
| | ZERO | 0 | 0 | 0 | 0 | 0 | 0 | 0 |
| | SMALL POS | 0 | 0 | 0 | 0 | -1 | -1 | -2 |
| | MED POS | 3 | 2 | 0 | 0 | -1 | -3 | -4 |
| | LARGE POS | 4 | 3 | 0 | 0 | -1 | -3 | -5 |

*FIG. 6*

| FUZZY CORRECTION SUBSET | CLEANING FIELD MAGNITUDE CORRECTION (VOLTS) |
|---|---|
| <5> | 3.10 |
| <4> | 1.30 |
| <3> | 0.45 |
| <2> | 0.15 |
| <1> | 0.05 |
| <0> | 0 |
| <-1> | -0.05 |
| <-2> | -0.15 |
| <-3> | -0.45 |
| <-4> | -1.30 |
| <-5> | -3.10 |

FIG. 7

THREE-INPUT, THREE-OUTPUT FUZZY LOGIC PRINT QUALITY CONTROLLER FOR AN ELECTROPHOTOGRAPHIC PRINTER

This application incorporates by reference U.S. patent Ser. No. 08/143,610, filed Nov. 1, 1993, entitled "Two-input, Two-output Fuzzy Logic Print Quality Controller for an Electrophotographic Printer," by the inventor hereof and assigned to the assignee hereof.

The present invention relates to a control system for maintaining print quality in an electrophotographic printer. More specifically, the present invention relates to a control system which uses "fuzzy logic" techniques whereby easily-measured output parameters of a printer may be used to adjust a small number of key input parameters in a system.

If very precise control of an electrophotographic process is desired, a designer of a high-precision system is confronted with a large number of process variables which individually and collectively have a profound effect on ultimate copy or print quality. Among these variables are the initial electrostatic charge placed on a charge-retentive surface, and the output power of a laser or other exposing device; these variables can generally be either set in advance or accurately controlled in the course of use of a printer. Other process variables similarly have significant effects on ultimate print quality, but are not so readily adjusted. Such variables include the dark-discharge properties of the charge-retentive surface, the interaction between the power of the initial charging device and the retention of that charge on the charge-retentive surface, and the variables associated with the complex interaction of charges in the development stage. These other important variables are not only difficult to control in an existing system, but the actual effect of any variable on the ultimate print quality may not be perfectly understood by the designer.

Further, the very idea of "print quality" is a flexible concept. What is considered high-quality in one printing context (very high black and white contrast, for example) may be unacceptable in another printing context. Generally, however, print quality can usually be satisfactorily expressed as two values, the optical density (i.e. darkness) of an area intended to be entirely covered with toner (the "solid-area density"), and "halftone density," which is the correlation between an observed optical density of a half-tone screen of toner and the intended proportion of toner coverage on the surface, such as 50%. Even if these two print quality concepts are precisely defined, however, a translation from a theoretically optimal set of process variables to an optimal set of solid-area and half-tone image densities is not easily obtained, and may not in fact exist. To adapt the system to optimize solid-area optical density may be at cross purposes with half-tone density. There may thus be forced a compromise between the two types of print quality. In addition to this basic compromise, a designer of a printer has only a limited number of process variables which may be meaningfully adjusted in the course of use of the machine. Thus, the control of even a relatively simple electrophotographic printer presents a designer with only a very small number of opportunities to control the system to obtain the elusive goal of optimal print quality across a range of conditions.

In recent years the mathematical technique of "fuzzy logic" has been theorized to obviate the complex, and probably imperfectly understood, multi-variable control of complicated processes such as electrophotography. The article by C. C. Lee, "Fuzzy Logic in Control Systems: Fuzzy Logic Controller, Parts I and II" in *IEEE Transactions in Systems, Man, and Cybernetics*, Vol. 20, No. 2, March/April 1990, pp. 404–435, demonstrates some basic mathematical principles underlying the "fuzzy logic" technique.

U.S. Pat. No. 5,204,718 discloses a process control device which uses fuzzy logic; however, this system uses a neural network responsive to a relatively large number of measured physical variables within the system, such as surface potential, degree of continuous use, and temperature and humidity, as inputs to obtain a theoretically optimal control over the toner supply.

U.S. Pat. No. 5,204,935 discloses a fuzzy logic circuit having an operations section memory unit in which the result of an operation to be outputted in response to an input is stored in an address specified by the input. The result of the operation is rewritable, so that the change in the contents of a fuzzy logic operation can be handled merely by rewriting the contents of the memory unit.

U.S. Pat. No. 5,214,476 discloses a fuzzy-logic control system for an image forming apparatus in which one measured input of the system includes the toner concentration in the developing unit sensed by a magnetic sensor.

According to one aspect of the present invention, there is provided a method of controlling a electrophotographic printing machine having a plurality of processing stations wherein toner is applied to a charge-retentive surface. Successive measurements of an optical density of applied toner on the charge-retentive surface, in areas thereof intended to have a predetermined toner coverage thereon, are accepted as inputs. Each input is assigned to at least one error subset. An adjustment parameter, relating to at least one processing station, is derived at least in part from an extent of joint membership of a plurality of inputs in an error subset.

According to another aspect of the present invention, there is provided a method of controlling a electrophotographic printing machine having a plurality of processing stations wherein toner is applied to a charge-retentive surface. A first control program accepts as inputs a first optical density of applied toner on the charge-retentive surface in a first area thereof intended to have complete toner coverage thereon, and a second optical density of applied toner on the charge-retentive surface in a second area thereof intended to have a first predetermined partial toner coverage thereon. The first control program outputs first and second adjustment parameters in response to the inputs to the first control program, each adjustment parameter relating to at least one developing station. A second control program accepts as inputs successive measurements of a third optical density of applied toner on the charge-retentive surface in a third area thereof intended to have a second predetermined partial toner coverage thereon. Each input to the second control program is assigned to at least one error subset. A third adjustment parameter, relating to at least one developing station, is derived at least in part from an extent of joint membership of a plurality of inputs in an error subset.

In the drawings:

FIG. 6 is an example of a two-input fuzzy-logic table usable with the control system of the present invention; and FIG. 7 is an example of a conversion table by which correction values derived from a table such as that shown in FIG. 5 may be converted to actual voltage values in an electrophotographic printer incoporating the control system of the present invention.

Figure 1:
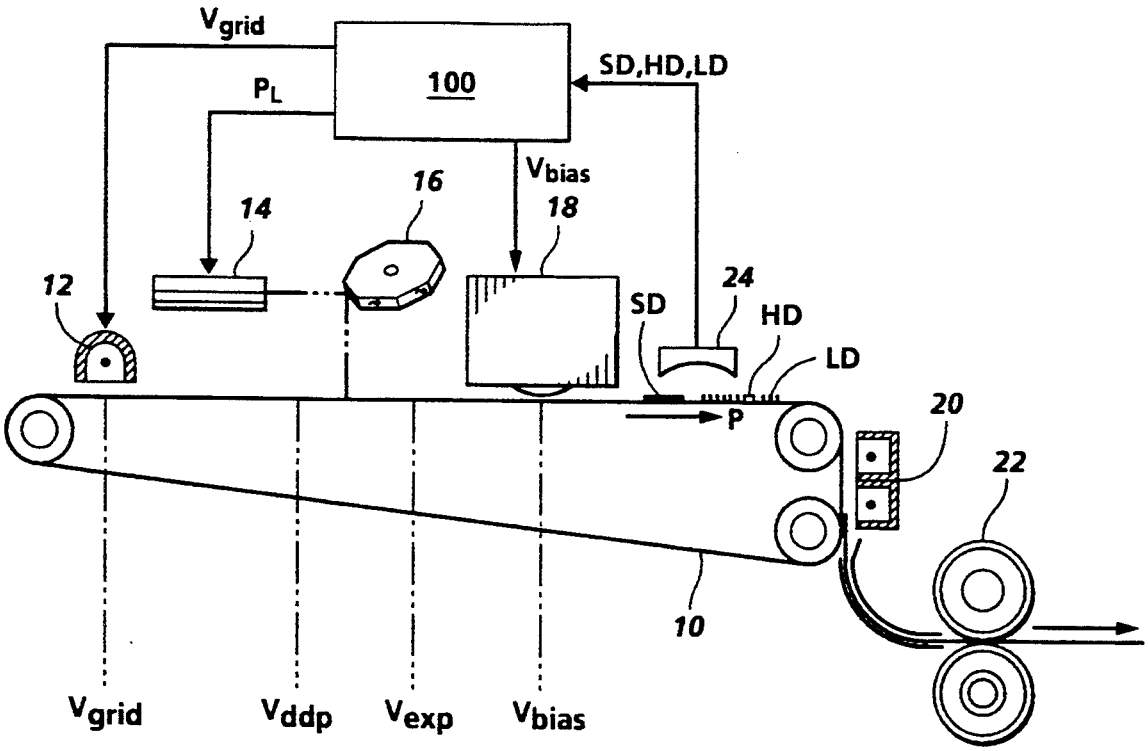
FIG. 1 PRIOR ART
FIG. 1 is a simplified elevational view of the basic elements of an electrophotographic printer.

FIG. 1 shows the basic elements of the well-known system by which an electrophotographic printer, generally known as a "laser printer," uses digital image data to create a dry-toner image on plain paper. There is provided in the printer a photoreceptor 10, which may be in the form of a belt or drum, and which comprises a charge-retentive surface. The photoreceptor 10 is here entrained on a set of rollers and caused to move through process direction P. Moving from left to right in FIG. 1, there is illustrated the basic series of steps by which an electrostatic latent image according to a desired image to be printed is created on the photoreceptor 10, how this latent image is subsequently developed with dry toner, and how the developed image is transferred to a sheet of plain paper. The first step in the electrophotographic process is the general charging of the relevant photoreceptor surface. As seen at the far left of FIG. 1, this initial charging is performed by a charge source known as a "scorotron," indicated as 12. The scorotron 12 typically includes an ion-generating structure, such as a hot wire, to impart an electrostatic charge on the surface of the photoreceptor 10 moving past it. The charged portions of the photoreceptor 10 are then selectively discharged in a configuration corresponding to the desired image to be printed, by a raster output scanner or ROS, which generally comprises a laser source 14 and a rotatable mirror 16 which act together, in a manner known in the art, to discharge certain areas of the charged photoreceptor 10. Although the Figure shows a laser source to selectively discharge the charge-retentive surface, other apparatus that can be used for this purpose include an LED bar, or, conceivably, a light-lens system wherein the light intensity is readily controllable; as used in the claims herein, such a device is indicated as an "exposer." The laser source 14 is modulated (turned on and off) in accordance with digital image data fed into it, and the rotating mirror 16 causes the modulated beam from laser source 14 to move in a fast-scan direction perpendicular to the process direction P of the photoreceptor 10. The laser source 14 outputs a laser beam having a specific power level, here shown as $P_L$, associated therewith.

After certain areas of the photoreceptor 10 are discharged by the laser source 14, the remaining charged areas are developed by a development unit such as 18 causing a supply of dry toner to contact the service of photoreceptor 10. In the present example, which shows "discharge-area development," the toner 18 will adhere only to those areas on the photoreceptor 10 which do not have a significant electrostatic charge thereon. The developed image is then advanced, by the motion of photoreceptor 10, to a transfer station including a transfer scorotron such as 20, which causes the toner adhering to the photoreceptor 10 to be electrically transferred to a print sheet, which is typically a sheet of plain paper, to form the image thereon. The sheet of plain paper, with the toner image thereon, is then passed through a fuser 22, which causes the toner to melt, or fuse, into the sheet of paper to create the permanent image. Some of the system elements of the printer shown in FIG. 1 are controlled by a control system 100, the operation of which will be described in detail below. As used in the claims herein, the term "processing stations" shall apply to any unit which affects the application of toner to the photoreceptor, such as (but not limited to) scorotron 12, laser source 14, or development unit 18.

Figure 2:
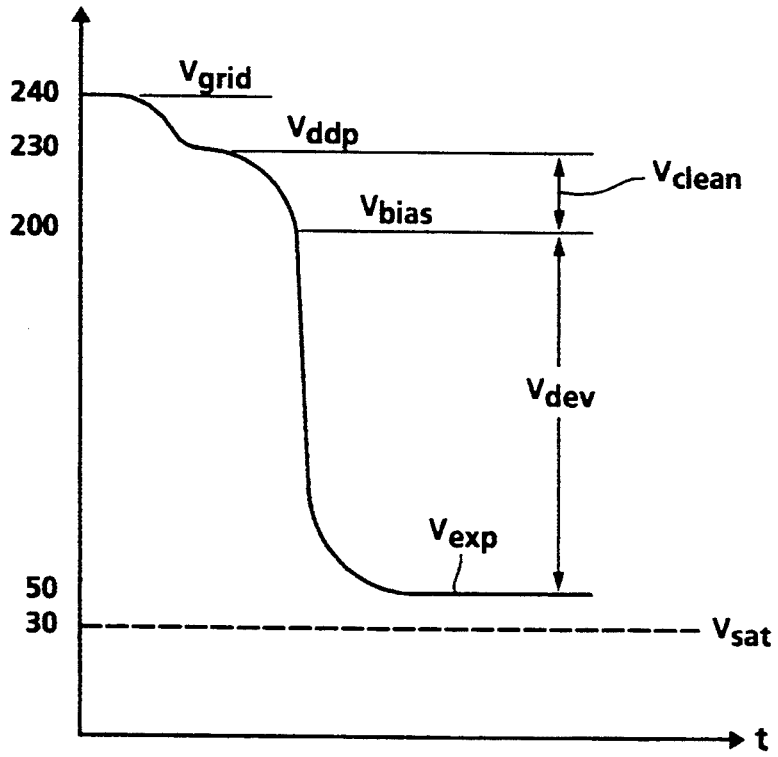
FIG. 2 PRIOR ART
FIG. 2 is a graph showing the relative potentials on a portion of a charge-retentive surface in an electrophotographic printer as it passes through a variety of stations.

Looking now at FIG. 2 and with continuing reference to FIG. 1, the electrostatic "history" of the representative small area on the photoreceptor 10 as it moves through the various stations in the electrophotographic process is described in detail. Here, the charge on the particular area of photoreceptor 10 is expressed in terms of an electrostatic potential (voltage) on that particular area of the surface. Starting with the initial charging of the surface by scorotron 12, an initial high potential $V_{grid}$ is placed on the given area; in this example $V_{grid}$ is 240 volts, but this is by way of example and not of limitation. Once an initial charge is placed on photoreceptor 10, this charge begins to decay immediately, to the extent that, by the time the representative area reaches the ROS, the potential is slightly decreased to a "dark decay potential," or $V_{ddp}$, in this example to 230 volts. At the exposure step, if the particular area in question is to be discharged by the action of the laser 14, the potential on that particular area will be markedly reduced, in this example to a value of $V_{exp}$ of 50 volts, which is low enough to ensure that toner will be attracted thereto, particularly relative to highly charged areas thereon.

Also associated with a system such as this is a bias voltage, $V_{bias}$, which is the voltage applied to the developer housing; $V_{bias}$ is a parameter which can be readily adjusted in the course of use of the printer. The difference between the dark decay potential $V_{ddp}$ and the bias voltage $V_{bias}$ is known as the "cleaning voltage" $V_{clean}$. Also shown in FIG. 2 is the development voltage $V_{dev}$, which is the difference between $V_{bias}$ and $V_{exp}$. The relevance of these values to print quality will be described in detail below.

Another important parameter in an electrophotographic printer is the "saturation" voltage $V_{sat}$, which is the theoretical maximum possible discharge when the laser source 14 is operating at full power. In the present example, $V_{sat}$ is 30 volts, which is to say that it is generally impossible for a laser of any practical strength to discharge a photoreceptor completely. The value of $V_{sat}$ is generally dependent on the nature of the photoreceptor 10 itself, and the maximum output of the particular laser 14 in the system has a generally asymptotic effect on the value of $V_{sat}$. In many instances, the value of $V_{sat}$ may be considered a constant, because even a great increase in the power of laser source 14 will not have a substantial effect on the value of $V_{sat}$.

The various values of potentials at different stages of the electrophotographic process all have an effect on the overall quality of a print made with the entire system. The idea of "print quality" can be quantified in a number of ways, but the system of the present invention relies on three distinct performance measurements on which to base a print-quality determination. These key measurements of print quality are (1) the solid area density, which is the darkness of a representative developed area intended to be completely covered by toner, (2) the halftone area density, which is the copy quality of a representative area which is intended to be approximately 40%–60% covered with toner, and (3) the light-area density, which is the copy quality of a representative area intended to be approximately 5%–25% covered with toner. The halftone is typically created by virtue of a dot-screen of a particular resolution, and although the nature of such a screen will have a great effect on the absolute appearance of the halftone, as long as the same type of halftone screen is used for each test, any common halftone screen may be used. Both the solid area and halftone density may be readily measured by optical sensing systems which are familiar in the art. As shown in the Figure, a densitometer generally indicated as 24 is used after the developing step to measure the optical density of a halftone test patch (marked HD), a light test patch (marked LD), and a solid test patch (marked SD) created on the photoreceptor 10 in a manner known in the art. Systems for measuring the true optical density of a test patch are shown in, for example, U.S. Pat. No. 4,989,985 or U.S. Pat. No. 5,204,538, both assigned to the assignee hereof and incorporated by reference herein.

Various potential values which affect print quality do so in many ways which are not fully understood. More subtly, there is evidence that certain values of potential incidental to the printing process may have effects on other potential values as well, again in ways which are imperfectly understood. The present invention proposes a system which uses "fuzzy logic" techniques to control this complicated, multi-variable process while using as inputs three readily-measurable output parameters, solid area density, halftone density, and light-area density, and thereby controlling three of the more readily-controlled system inputs, namely the charge voltage of the scorotron 12, the bias voltage $V_{bias}$ associated with the devlopment unit 18, and the laser power $P_L$ of laser source 14.

Figure 3:
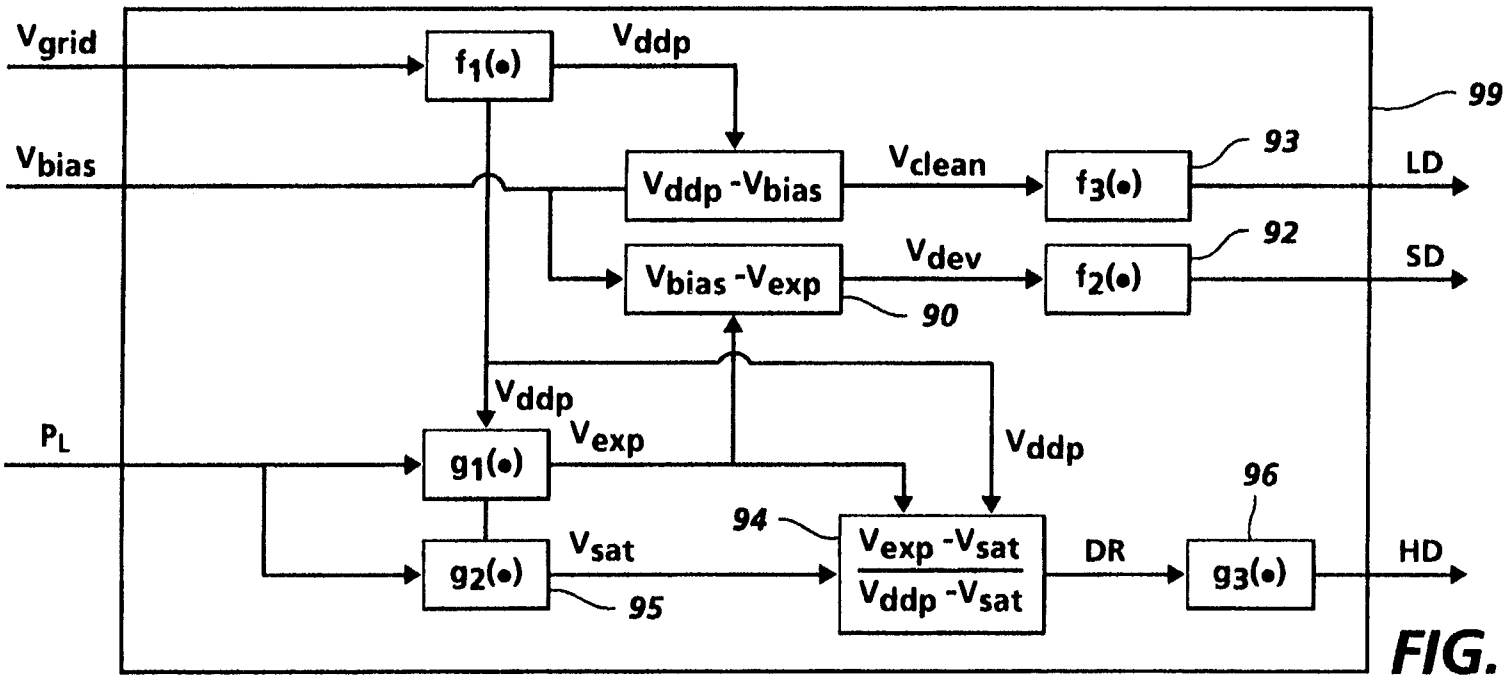
FIG. 3 is a systems diagram showing the interrelationship of various functions and potentials within the representative electrophotographic printer of FIG. 1.

FIG. 3 is a systems diagram showing the basic interactions among the various potentials that are relevant to the electrophotographic process. In the diagram it may be seen that certain relationships between relevant potentials are neatly mathematically related, while more subtle or complicated relationships, such as the relationship of $V_{grid}$ to $V_{ddp}$, are shown as empirical relationships such as $f_1$, $f_2$, $f_3$, $g_1$, $g_2$, and $g_3$. Certain relationships of interest that may be seen in FIG. 3 include the development voltage $V_{dev}$, which is the difference between $V_{bias}$ and $V_{exp}$, shown at the box indicated as 90, and which has been shown to have an empirical relationship, through a function $f_2$ in box 92, to the solid area density SD; and the value of $V_{clean}$, which is the difference between $V_{ddp}$ and $V_{bias}$, has an empirically-determinable relationship $f_3$ to the value of LD. Also significant is the concept of the "discharge ratio" DR, which is theorized to have a highly correlative relationship, such as through a function $g_3$ in box 96, to the halftone density HD. This discharge ratio indicated in box 94 is given as a ratio shown in FIG. 3, which takes into account the saturation voltage $V_{sat}$ of the particular photoreceptor, which, incidentally, is also related somewhat to the laser power $P_L$ by a relationship $g_2$ indicated in box 95, although the value of $V_{sat}$ has been found to be substantially constant for a given apparatus.

It will be noted that the complex interactions among the various potentials in the electrophotographic process are here organized into a single "black box" indicated as 99, with the relevant inputs and outputs being limited to those outputs which may be readily measured, and those inputs which may be readily controlled. Namely, the relevant outputs of black box 99 are the solid area density SD, the halftone density HD, and the light density LD. By the same token, the inputs to the black box 99 are: the voltage associated with the scorotron 12, shown as $V_{grid}$, and the power of laser source 14, here shown as $P_L$; and the bias voltage $V_{bias}$ which is associated with the development unit 18.

Co-pending U.S. patent application Ser. No. 08/143,610, incorporated herein by reference, discloses a fuzzy-logic system which accepts as input two measured densities, the solid density SD, and the halftone density HD. In response to combinations of such readings, the system outputs values for the adjustments of $V_{grid}$ and $P_L$, forming a two-input, two-output fuzzy logic controller. As described in that application, the two measured inputs of SD and HD are submitted to fuzzy-logic analysis. First, the respective measurements are assigned to joint membership in error subsets. These joint memberships are then used to calculate extents of joint membership in a set of possible error subset spaces. The joint memberships are then fed into a multi-dimensional set of correction values for an adjustable physical parameter, such as $V_{grid}$ or $P_L$. The extents of joint membership of a solid-density error value SD and the halftone density error value HD in each error subset space are applied as weighted inputs to the set of correction values to yield a weighted correction value each adjustable physical parameter, and the parameter is then adjusted according to the correction value.

In the two-input, two-output fuzzy-logic controller described in detail in the referenced application, each of the two inputs (HD or SD, or error values relating thereto) are applied to seven error subsets, typically with each error read having membership in two such error subsets. The seven error subsets for each of the two input readings are combined to form a $7\times7$ error subset matrix, and, in the embodiment described in the referenced application, each correction value on the $7\times7$ matrix is on a scale from $-5$ to 5, making in all 11 possible fuzzy actuation correction subsets, which are ultimately converted and applied to the actual controls of $V_{grid}$ and $P_L$.

A two-input fuzzy-logic controller as described in the referenced application requires at least one two-dimensional matrix for an understanding and application of joint memberships of the error subsets in the row and column of each matrix. That is, in a typical matrix, the error subsets of one input such as HD form the rows of the matrix, while the error subsets of the other input such as SD form the columns. Each individual slot in the matrix will therefore represent a unique combination of HD and SD error subsets, and will thus have assigned thereto a "correction value" responsive to that unique combination. While two-dimensional matrices are easily comprehended and converted to usable look-up tables, the situation may become burdensome in the case of a three-input fuzzy-logic controller. In any kind of three-input fuzzy-logic controller, joint memberships in three sets of error subsets must be determined, which requires the use of three-dimensional matrices. While three-dimensional matrices do not present a serious problem in the sense of consuming space for a look-up table in a computer memory, a more pressing problem is the original creation of such a look-up table, such as based on empirical data.

Although many techniques are currently available for complex empirical evaluation of multivariable systems, such as genetic algorithms, the system of the present invention proposes a three-input, three-output system, particularly suited for control of electrophotographic printers, which does not require the construction of a three-dimensional empirical matrix of correction values. According to a preferred embodiment of the present invention, certain measurement inputs, particularly the density values of SD and HD test patches (or error values based on comparison with actual measurements with ideal values), are fed into a two-input fuzzy-logic control program, such as that described in the application incorporated herein. At the same time, the third input, which in this case is the light density LD measurement, is fed into a separate fuzzy-logic analysis program. Two values of the LD measurement are taken into account: an LD reading from a first print, and an LD reading from a subsequent print. In this way, a three-input system is in effect rendered as two separate two-input systems, in which one of the two-input systems receives two measurements of the same type of density, separated in time.

Figure 4:
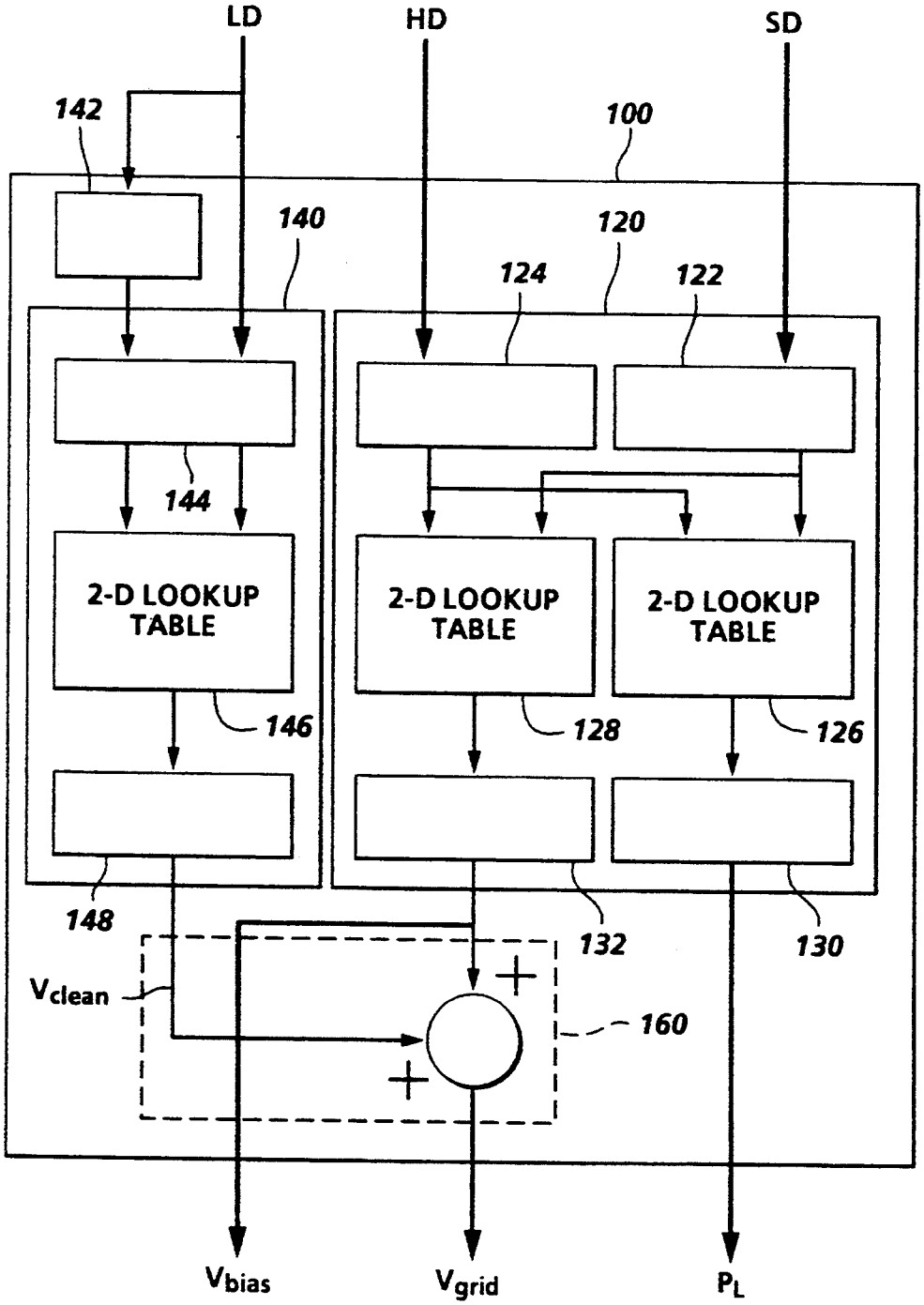
FIG. 4 is a systems diagram showing the control system according to the present invention.

FIG. 4 is a simplified systems diagram giving an overview of the three-input, three-output fuzzy-logic system according to the present invention. As can be seen with a comparison with FIG. 1, the system as the whole is indicated by the box 100. The inputs to the control system 100 are given as the measured values of SD, HD, and LD. The outputs of the control system 100 are given as $P_L$, $V_{grid}$, and $V_{bias}$, all of which are parameters which can be fairly directly controlled in real time in an electrophotographic printer, by, for example, adjusting a potentiometer operatively associated with, respectively, the the laser source 14, corotron 12, or the development unit 18.

Within the control system generally indicated as 100 are two distinct programs, here generally indicated as 120 and 140. The word "program," as used herein, is intended to mean a program, such as can be embodied in an independent computer or a portion of a computer, which may include the use of look-up tables and other algorithms which are used to respond to certain inputs thereto with certain outputs. Although, in the preferred embodiment hereof, these programs incorporate fuzzy-logic techniques, it is intended within the scope of the present invention that such functions need not actually carry out the technique in real time: that is, it is conceivable that the programs such as 120 and 140 could consist essentially entirely of look-up tables wherein unique combinations of inputs are responded to with a unique combination of outputs, the actual values of the possible outputs having been calculated beforehand and merely placed in a look-up table.

At any rate, in the preferred embodiment of the invention shown, it can be seen, looking first at program 120, that the input readings of SD and HD, which may also be input as error values when such values of SD and HD are compared with ideal values, are entered into fuzzification functions shown as 122 and 124; in either case, what occurs is that the error values of SD and HD are assigned to one or more error subsets such as no error, low negative, high negative, medium negative, medium positive, etc., in a manner which will be described in detail below. The memberships in these error subsets are then in turn applied to two-dimensional look-up tables, as represented by functions 126 and 128, in order to determine the extent of joint memberships of the various error subsets and derive therefrom correction values based on the extent of joint membership in unique combinations of error sets from the fuzzification functions 122 and 124. Finally, the correction values from the respective look-up tables 126 and 128 are "defuzzified" and converted to real-world parameter adjustments in functions 130 and 132, yielding, as shown, an adjustment to $P_L$, and an adjustment to $V_{bias}$. The illustrated technique carried out in program 120, as applied to electrophotographic printing, is taught in the application incorporated by reference, or else the teaching of that application could be adapted for the purpose here described. In the referenced patent application, the desired output parameters were $P_L$ and $V_{grid}$, as opposed to $V_{bias}$, but it will be apparent to one skilled in the art that an empirical function, particularly as relating to the two-dimensional look-up table 128, may be created in order to effect the proper output value of $V_{bias}$ in the context of the system of the present invention.

In addition to the two-input, two-output program 120 within the general control system 100, there is also provided a program 140, which accepts two inputs, the measured reflectivity value of a light density LD test patch, and, the value of a previous measurement of an LD test patch in a series of prints. In other words, the two inputs to program 140 are two successive measurements of different light-density test patches, i.e., measurements which are separated in time, but preferably in the course of making a series of prints in a single "run" of the apparatus. (Once again, the value of LD can be converted to an error value of LD, by comparison of the actual measured value of LD with an ideal value; it is to be understood that, for purposes of the claims herein, a "measurement" could also imply an error value based on comparing the measurement with an ideal.) The time delay is preferably effected by a function such as 142 which may separate the input values by one or more prints.

Figure 5:
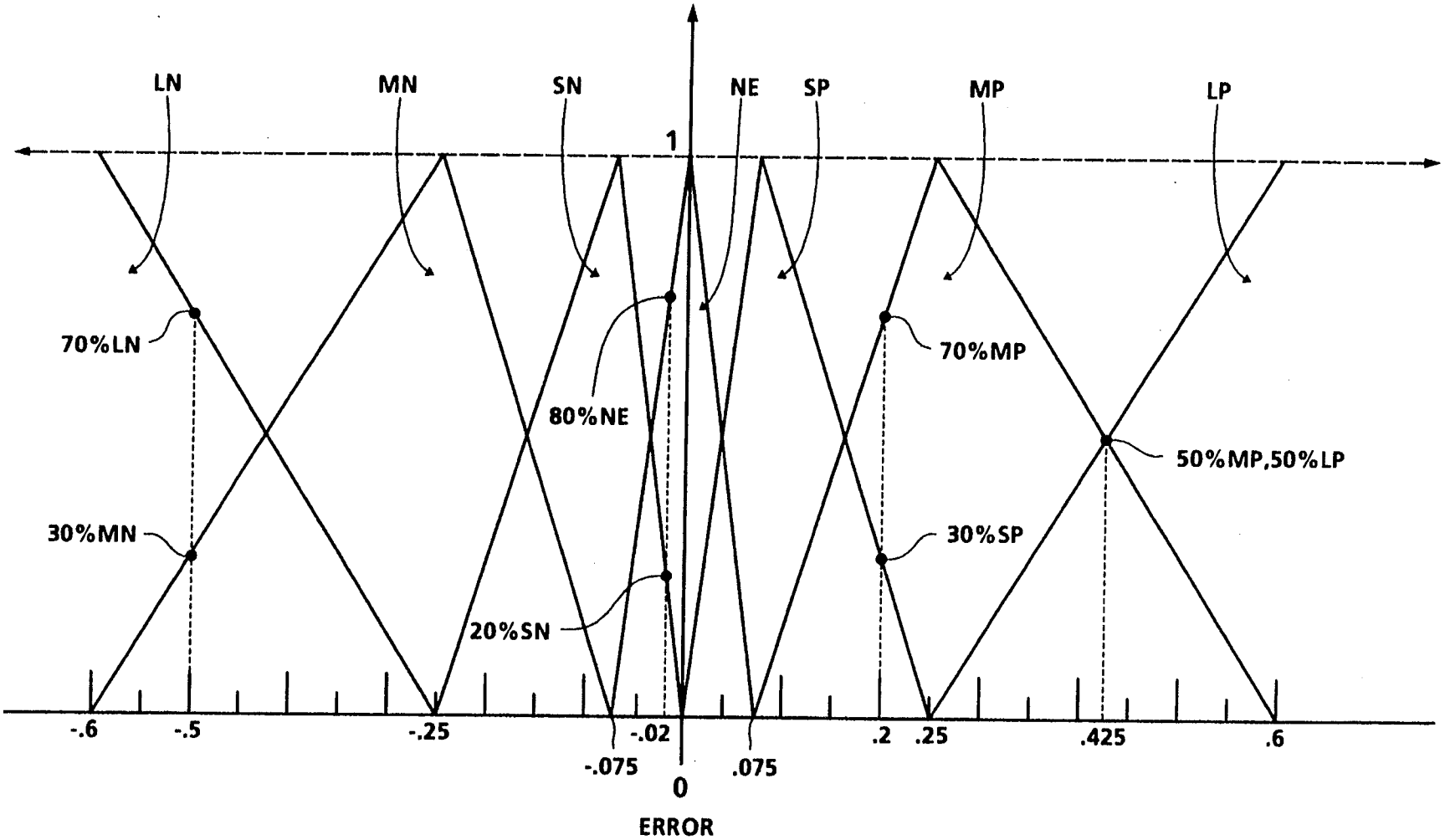
FIG. 5 is a graph illustrating the principle of assigning a scalar error value to one or more error subsets, according to the present invention.

The successive LD values are applied to a fuzzification function 144, wherein each individual measurement, whether directly from the most recent LD reading, or from delay function 142. FIG. 5 is shown as a possible example of how a scalar error is assigned to a plurality of error subsets in a fuzzy-logic technique. The scale of possible error values are divided into usable ranges, such as no error, small positive, small negative, medium positive, medium negative, large positive, and large negative. Whereas a straightforward scalar system may begin one error range where another ends (such as between a medium positive and a large positive), the fuzzy logic technique proposes that the various error ranges, known as error subsets, overlap to usually symmetrical extents. Thus, a single scalar value of an error may be construed as being partially within one error subset, and partially within another error subset.

The horizontal axis of the graph of FIG. 5 shows a range relative to zero error, in which a measured error value may fall, from a large negative to a large positive.

The vertical axis of the graph represents a proportion, from 0 to 1, of how much a given value on the horizontal axis will be disposed within a number of error subset spaces. The variety of diagonal lines superimposed on the graph indicate, in a linear sense, how much a measured error on the horizontal axis will be within each error subset. The center triangle, corresponding to the error value of −0.75 to +0.75, is in this example construed as being the "no error" NE subset. The measured error need not be exactly zero to place the measured error to some extent in the "no error" subset; however, as a measured error "moves away from" scalar zero, the measurement is considered to be less and less in the no-error subset. Further in this example, the error value from 0 to 0.25 is considered the "small positive" (SP) error subset, from 0.075 to 0.6 the "medium positive" (MP) error subset, and above 0.25 the "large positive" (LP) subset. As can be seen in FIG. 5, a symmetrical arrangement exists for the negative portion of the graph. It will further be noticed that a decreasing extent of one error set is matched by a complementary increase in a neighboring set for the same location along the horizontal axis; for example, for a horizontal value from 0.075 to 0.25, as the extent of the SP error subset decreases, the extent of the MP error subset increases in an exactly complementary fashion.

Thus, to take one example, a typical LD error reading which is somewhat positive, as shown as +0.2, will be rendered as, for example, 70% in the small-positive subset and 30% in the medium-positive subset, the combined memberships in the two subsets adding to 1. Other examples, relating to other scalar errors, are shown as well in FIG. 5. The two error subset values from the fuzzification function 144, weighted as necessary among multiple error subsets, are then applied to a two-dimensional look-up table 146.

FIG. 6 shows a typical representative look-up table to which error subset values can be applied. As can be seen, the table of FIG. 6 is a two-dimensional matrix wherein the column headings represent the error subsets of the current LD reading, while the row headings represent the possible error subsets of a previous LD reading, such as would come from delay function 142. Each slot in the two-dimensional matrix represents a unique combination of error subsets, and in each slot in the matrix of FIG. 6 can be found a correction value on a scale from −5 to 5. These correction values ultimately relate to actual real-world adjustments to a parameter of the machine. The table of FIG. 7, which will be described in detail below, shows one possible example of a conversion table between correction values in the left column, and actual cleaning field magnitude correction values, in the right column.

Applying general principles of fuzzy-logic control to the table of FIG. 6, assume for example that the present error reading fed through fuzzification function 144 is 0.7 in the small negative subset, and 0.3 in the medium negative subset. Further assume that in the previous low density LD error, the error subsets were 0.5 in small negative and 0.5 in medium negative (and, of course, zero for all other subsets). These distributions are shown in the margins of the table. Thus, the error subsets of interest in the two-dimensional look-up table in FIG. 6 are those in the shaded areas. Weights are assigned to each of these four slots in the matrix on the basis of the joint membership of the two errors in the indicated conditions, obtained by taking the minimum of the two memberships. So:

Joint membership (present error=MED NEG, previous error=MED NEG)=minimum (0.3, 0.5)=0.3

Joint membership (present error=SMALL NEG, previous error=MED NEG)=minimum (0.7, 0.5)=0.5

Joint membership (present error=MED NEG, previous error=SMALL NEG)=minimum (0.3, 0.5)=0.3

Joint membership (present error=SMALL NEG, previous error=SMALL NEG)=minimum (0.7, 0.5)=0.5.

After all four have been computed, the values are weighted so that the sum of all the joint memberships is 1.00. In such a case, all of the joint memberships are divided by 1.6 (i.e., 0.3+0.5+0.3+0.5). The fuzzy actuation adjustments for this example can then be extracted from the two-dimensional look-up table of FIG. 7, by multiplying the correction values in the relevant slots in the two-dimensional matrix by coefficients based on the normalized joint membership of the error subsets in the relevant slots. The individual correction values in the respective slots within the two-dimensional matrix each correspond to actual real-world cleaning field magnitude correction values expressed in volts, as can be found in the conversion table of FIG. 7; so that, for example, a correction value of 3 from the table of FIG. 3 is converted to 0.45 volts and a correction value of 1 is converted to 0.05 volts.

Converting the basic fuzzy correction values to actual voltage values, and applying these values to a weighted equation, the actual voltage correction can be calculated:

$$[(0.45)0.3+(0.05)0.5+(0.5)0.3+(0.05)0.5]/1.6=0.1\text{-}25 \text{ volts}$$

wherein the terms in parentheses are the voltage correction values and the values not in parentheses are the extents of joint memberships in particular slots, all normalized by the normalization factor 1.6, the sum of the joint memberships. Therefore, under these particular conditions, the cleaning field voltage should be increased by 0.125 volts.

Of course, the value of the $V_{clean}$ adjustment, which is ultimately derived from program 140, is in fact the difference between the values of $V_{bias}$ and $V_{ddp}$. Of these, only $V_{bias}$, which is ultimately related to $V_{grid}$, can be readily adjusted in the course of operating a printing machine. There thus may be provided some sort of function within function 100, and here generally indicated as 160, to take the calculated correction values for $V_{bias}$ and $V_{clean}$ and derive therefrom, through a simple algorithm, appropriate adjustment values for $V_{grid}$. Alternately, the program 120 could be so designed that one of the outputs therefrom is not $V_{dev}$ but $V_{grid}$, such as in the referenced patent application, and derive therefrom a suitable adjustment to $V_{bias}$ which could be applied directly to development unit 18.

In addition to simplifying the setup of an empirically-based fuzzy-logic control system having three inputs, the particular "short-cut" represented by the system of the present invention retains certain unique advantages. It has been observed that, in the main, light halftone densities such as LD are closely related to the values of $V_{clean}$, but are also fairly well decoupled from (that is, generally independent of) the physical factors having most effect on the values of SD and HD. Thus, decoupling the $V_{clean}$ correction by program 140 does not have much of an effect on the behavior of the program 120, which responds to the SD and HD values. In large part, the correction system responsive to SD and HD remains fairly independent of the control system which responds to LD.

The program 140 relies on a relatively long time constant based on using separated-in-time readings of LD in the course of printing a number of prints. It is part of the design of the system of the present invention that the LD halftone errors are simply corrected more slowly; this design is convenient because low-density errors are less noticeable, over a succession of prints, than errors in SD and HD. Another reason for correcting the LD errors more slowly, and separately from the other density errors, is that the range over which $V_{clean}$ may vary is comparatively small, and the ability of adjustments to $V_{clean}$ to change the LD density is correspondingly limited. Even when there are significant errors in the LD halftone density, if there are also errors in the higher densities, it is most convenient to hold the value of $V_{clean}$ constant until the values of the higher densities SD and HD are fairly stabilized. That is, for the best print quality over time, it is better to allow the higher density corrections to take place first, because such higher density corrections are more noticeable, and then allow the LD-responsive aspects of the system to adapt to the system afterwards. Nevertheless, appropriately changing the value of $V_{clean}$ has been shown to hold the response of the entire printing system at the low-density end constant over a fairly wide range of normal xerographic conditions.

While this invention has been described in conjunction with various embodiments, it is evident that many alternatives, modifications, and variations will be apparent to those skilled in the art. Accordingly, it is intended to embrace all such alternatives, modifications, and variations as fall within the spirit and broad scope of the appended claims.

I claim:

1. A method of controlling an electrophotographic printing machine having a plurality of processing stations wherein toner is applied to a charge-retentive surface, comprising the steps of:

accepting as inputs successive measurements of an optical density of applied toner on the charge-retentive surface in areas thereof intended to have a predetermined toner coverage thereon;

assigning each input to at least one error subset; and deriving an adjustment parameter relating to at least one processing station, at least in part from an extent of joint membership of a plurality of inputs in an error subset.

2. The method of claim 1, wherein the deriving step includes deriving an adjustment parameter for controlling at least one of a charge source for placing an initial charge on the charge-retentive surface, an exposer for selectably discharging portions of the charge-retentive surface, and a development unit for electrostatically applying toner on the charge-retentive surface.

3. The method of claim 1, wherein the accepting step includes accepting inputs to the control program relating to successive measurements of an optical density of applied toner on the charge-retentive surface in areas thereof intended to have a predetermined toner coverage thereon of less than 25%.

4. The method of claim 3, wherein the deriving step includes deriving an adjustment parameter relating to a cleaning voltage associated with the charge-retentive surface and a processing station.

5. A method of controlling a electrophotographic printing machine having a plurality of processing stations wherein toner is applied to a charge-retentive surface, comprising the steps of:

accepting as inputs in a first control program, a first optical density of applied toner on the charge-retentive surface in a first area thereof intended to have complete toner coverage thereon, and a second optical density of applied toner on the charge-retentive surface in a second area thereof intended to have a first predetermined partial toner coverage thereon;

outputting first and second adjustment parameters in response to the inputs to the first control program, each adjustment parameter relating to at least one processing station;

accepting as inputs in a second control program, successive measurements of a third optical density of applied toner on the charge-retentive surface in a third area thereof intended to have a second predetermined partial toner coverage thereon;

assigning each input to the second control program to at least one error subset; and deriving a third adjustment parameter, relating to at least one processing station, at least in part from an extent of joint membership of a plurality of inputs in an error subset.

6. The method of claim 5, wherein the step of deriving a third adjustment parameter includes deriving an adjustment parameter for controlling at least one of a charge source for placing an initial charge on the charge-retentive surface, an exposer for selectably discharging portions of the charge-retentive surface, and a development unit for electrostatically applying toner on the charge-retentive surface.

7. The method of claim 6, wherein the step of outputting first and second adjustment parameters includes outputting an adjustment parameter relating to a power value associated with the exposer.

8. The method of claim 7, wherein the step of outputting first and second adjustment parameters includes outputting an adjustment parameter relating to a bias voltage associated with the development unit.

9. The method of claim 8, wherein the deriving step includes deriving a third adjustment parameter relating to a cleaning voltage associated with the charge-retentive surface and the development unit.

10. The method of claim 9, further comprising the step of combining the bias voltage and cleaning voltage to yield a fourth adjustment parameter relating to a voltage associated with the charge source.

* * * * *